US005842069A

United States Patent [19]

Konno

[11] Patent Number: 5,842,069

[45] Date of Patent: Nov. 24, 1998

[54] MONITOR CAMERA TRANSPORTING APPARATUS BY MEANS OF COMPRESSED AIR

[76] Inventor: Kenichi Konno, c/o Kyowakogyo Co., Ltd., 22-20, Asahi-cho 1-chome, Atsugi-shi, Kanagawa, Japan

[21] Appl. No.: 976,287

[22] Filed: Nov. 21, 1997

[30] Foreign Application Priority Data

Nov. 29, 1996 [JP] Japan ..... 8-320111

[51] Int. Cl.[6] ..... G03B 17/24

[52] U.S. Cl. ..... 396/419; 396/429; 348/82; 348/157

[58] Field of Search ..... 396/1, 19, 20, 396/24, 419, 427, 429; 348/82–85, 157

[56] References Cited

U.S. PATENT DOCUMENTS

| | | | |
|---|---|---|---|
| 2,538,910 | 1/1951 | Miller | 348/157 |
| 3,768,418 | 10/1973 | Yoshida | 104/161 |
| 4,943,821 | 7/1990 | Gelphman et al. | 396/20 |
| 5,645,268 | 7/1997 | Konno | 254/134.4 |

*Primary Examiner*—David M. Gray

*Attorney, Agent, or Firm*—McAulay Nissen Goldberg Kiel & Hand, LLP

[57] ABSTRACT

A monitor camera transporting apparatus (10) which comprises rails (12) laid along a transportation path of a monitor camera (11), a carriage (21) having the monitor camera mounted thereon and movable along the rails, and transporting means (31) for moving the carriage by means of compressed air. The transporting means includes a pipe (32) provided parallel to the rails and having a slit (32*a*) formed in its lower part along a full length of the pipe, an internal moving body (34) movable within the pipe by means of compressed air introduced into the pipe, a connecting plate (33) connected at its one end to the internal moving body and externally projected at the other end through the slit to be connected with the carriage, a sealing wire (36) disposed within the pipe along the full length of the pipe to close the slit, and a wire retracting part (37*k*) formed in the internal moving body or connecting plate for retracting inwardly of the pipe the sealing wire located at the connecting plate. Thereby, even at such dangerous place where no persons are allowed to enter and no electric motors can be used, the monitor camera can be transported efficiently, safely and reliably even to such an object in the dangerous place to be photographed as moving at a high speed to observe the inside of the place.

3 Claims, 8 Drawing Sheets

MONITOR CAMERA TRANSPORTING APPARATUS BY MEANS OF COMPRESSED AIR

BACKGROUND OF THE INVENTION

1. Field of the Invention

The present invention relates to monitor camera transporting apparatus which utilize compressed air and more particularly, to a monitor camera transporting apparatus based on compressed air, which can be used to observe interior of a pipe in which no persons cannot enter, to monitor interior of a facility or to photograph such a subject as moving at a high speed.

2. Description of the Related Art

For the purpose of observing the interior of a pipe in which no persons cannot enter physically or from the viewpoint of safety or monitoring the inside of a facility, a self-propelled monitor camera transporting apparatus driven by an electric motor has been conventionally run through the pipe or facility to photograph inside of the pipe or facility so that an operator can observe or monitor the inside safely and reliably on the basis of the photographed video images.

Meanwhile, when movements of competitions in a field and track events stadium are broadcast on TV, an operator or cameraman carrying a monitor camera is stationed in the vicinity of an athlete and following the movement of the athlete, he also moves to photograph necessary video images with use of the monitor camera, or the operator zooms in on the athlete for close-up from the monitor camera installed in the stand of the stadium.

SUMMARY OF THE INVENTION

However, such a self-propelled monitor camera transporting apparatus based on an electric motor as mentioned above cannot be used because, at such a location that a flammable substance such as an organic solvent or a flammable gas is put, there is a danger that an electric spark in the motor may cause a fire leading to a fire incident. There is another problem with the above apparatus that, even when the cameraman wants to photograph the athlete running at a high speed as in a sprint race of the stadium, it is highly difficult for the cameraman to follow the athlete for photographing and thus it is impossible to acquire strong appealing video images.

It is therefore an object of the present invention to provide a monitor camera transporting apparatus based on compressed air, which can observe and monitor inside of such a place that no persons cannot access and any electric motor cannot be used, and can be transported efficiently, safely and reliably up to a subject moving at a high speed to obtain clear and strong appealing video images.

In accordance with an aspect of the present invention, there is provided, as shown in FIGS. 1 and 4, a monitor camera transporting apparatus based on compressed air, which comprises rails laid along a transportation path of a monitor camera; a carriage having the monitor camera mounted thereon and movable along the rails; and transporting means for moving the carriage by means of compressed air, and wherein the transporting means includes a pipe provided parallel to the rails and having a slit formed in its lower part along a full length of the pipe, an internal moving body inserted into the pipe and movable within the pipe by means of compressed air introduced into the pipe, a connecting plate connected at its one end to the internal moving body within the pipe and projected at the other end externally of the pipe through the slit, the carriage being connected to the projection, a sealing wire disposed within the pipe along the full length of the pipe to close the slit, and a wire retracting part formed in the internal moving body or connecting plate for retracting inwardly of the pipe the sealing wire located at the connecting plate.

In the present invention, the carriage is moved by means of the compressed air along the rails as rested thereon. As the carriage is moved, the monitor camera mounted in the upper part of the carriage is also transported along the rails.

In the transporting means for moving the carriage, the slit of the pipe is closed by the sealing wire, the sealing wire is inserted into the wire retracting part, and the connecting plate is passed through the slit, under which condition the internal moving body is inserted into the pipe, the carriage is connected to the connecting plate, and then the compressed air is introduced into the pipe, so that the internal moving body is propelled and, at the same time, the carriage is tracked and the monitor camera is transported. At a position over which the connecting plate passes, the sealing wire is retracted inwardly of the pipe into the wire retracting part, so that it can be avoided that the sealing wire blocks the movement of the internal moving body caused by the compressed air and thus the sealing wire cannot be damaged by the movement of the internal moving body.

In the present invention, as shown in FIG. 3, the carriage includes a carriage body having rollers which are provided at its front and rear ends to be rollingly moved on the rails, an auxiliary plate mounted in an upper part of the carriage body, a base plate on which the monitor camera is mounted, and shock absorbers disposed between the auxiliary plate and base plate, and the projection of the connecting plate is mounted onto the side face of the carriage body.

In this connection, the rollers cause smooth movement of the carriage along the rails, and the provision of the shock absorbers between the auxiliary plate and base plate prevents vibration of the carriage body from being transmitted directly to the monitor camera.

In this case, as shown in FIG. 2, a resilient member is fixedly mounted on upper faces of the rails on which the rollers are roll along the full length of the rails.

Since the resilient member is fixedly mounted on the upper faces of the rails along the full length of the rails, noise generated by running of the carriage on the rails can be suppressed.

BRIEF DESCRIPTION OF THE DRAWINGS

The above and other objects, features and advantages of the present invention will become apparent from the following detailed description when taken with the accompanying drawings in which.

DESCRIPTION OF THE PREFERRED EMBODIMENTS

An embodiment of the present invention will be explained in detail with reference to the accompanying drawings.

Figure 1:
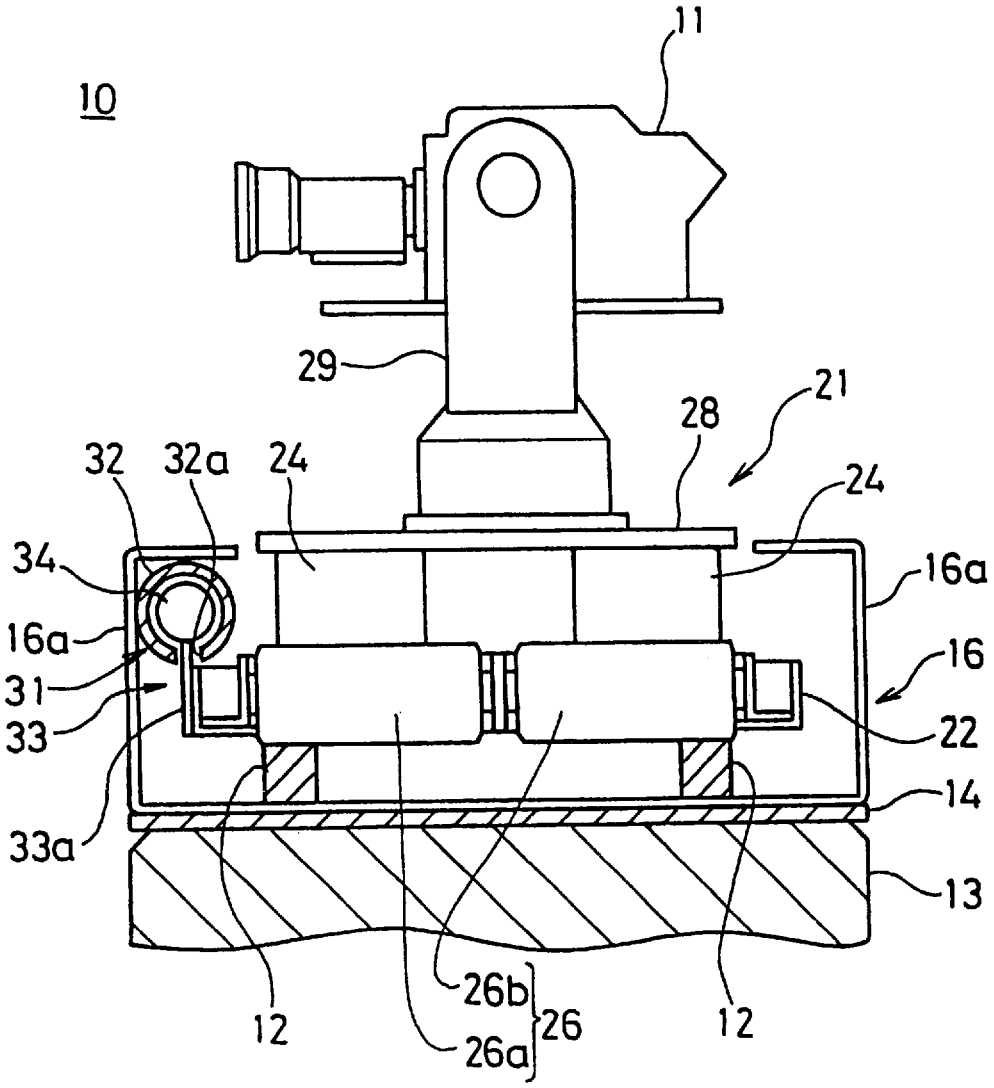
FIG. 1 is a front view of a monitor camera transporting apparatus in accordance with the present invention by means of compressed air.
Figure 2:
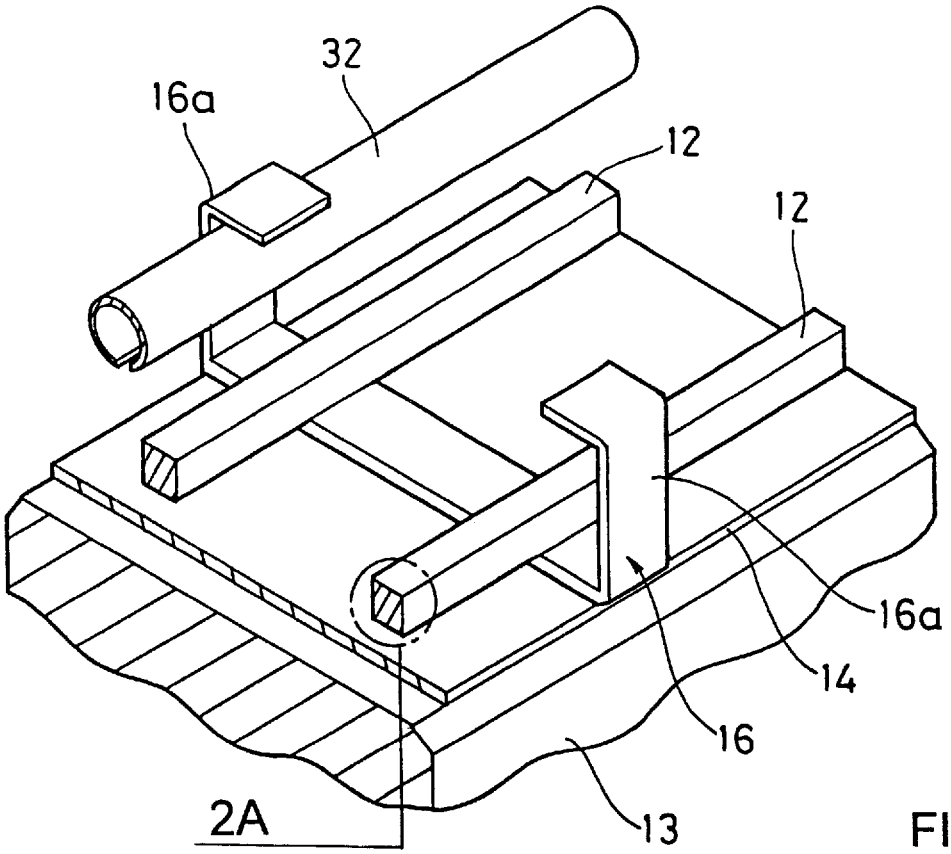
FIG. 2 is a perspective view of a part of the apparatus, showing how rails and a pipe are laid.
Figure 2A:
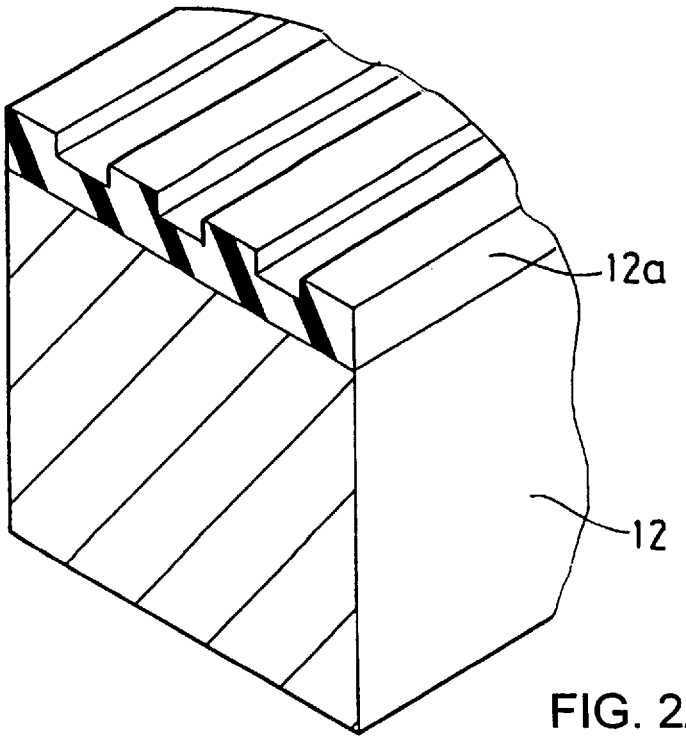

As shown in FIGS. 1 and 2, a monitor camera transporting apparatus 10 comprises a pair of rails 12 and 12 provided along a transportation path of a monitor camera 11, a carriage 21 having the monitor camera 11 mounted on its upper part and movable along the rails 12 and 12, and a transporting means 31 for moving the carriage 21 by means of compressed air. Previously laid along a full length of the transportation path of the monitor camera 11 is a block 13 made of concrete on an upper surface of which a wooden plate 14 is fixedly mounted. The pair of rails 12 and 12 are laid on the wooden plate 14 through a bracket 16 along the full length of the transportation path of the monitor camera so that the monitor camera is spaced by a predetermined distance from the rails. The monitor camera 11 has a receiver and a transmitter (not shown). The camera 11 is adapted to photograph a subject by signals received from a monitor station and to transmit photographed images to the monitor station.

The bracket 16 is provided at its both ends with a pair of upright parts 16*a* and 16*a,* upper ends of which are bent mutually inwardly. A plurality of such brackets 16 (only one of which is illustrated in FIG. 1) are provided on the wooden plate 14 as spaced by a predetermined distance in a longitudinal direction. The pair of rails 12 and 12 are mounted on the brackets 16 by means of screw means (not shown) between the pair of upright parts 16*a* and 16*a,* and a pipe 32 as the transporting means 31 is fixed mounted to an upper part of one of the upright parts 16*a.* As shown by an enlarged view in FIG. 2, a grooved raw rubber sheet 12*a* of a resident member is secured onto an upper face of each of the rails 12 along the full length of the rails 12 to suppress noise caused by running of the carriage 21 therealong.

Figure 3:
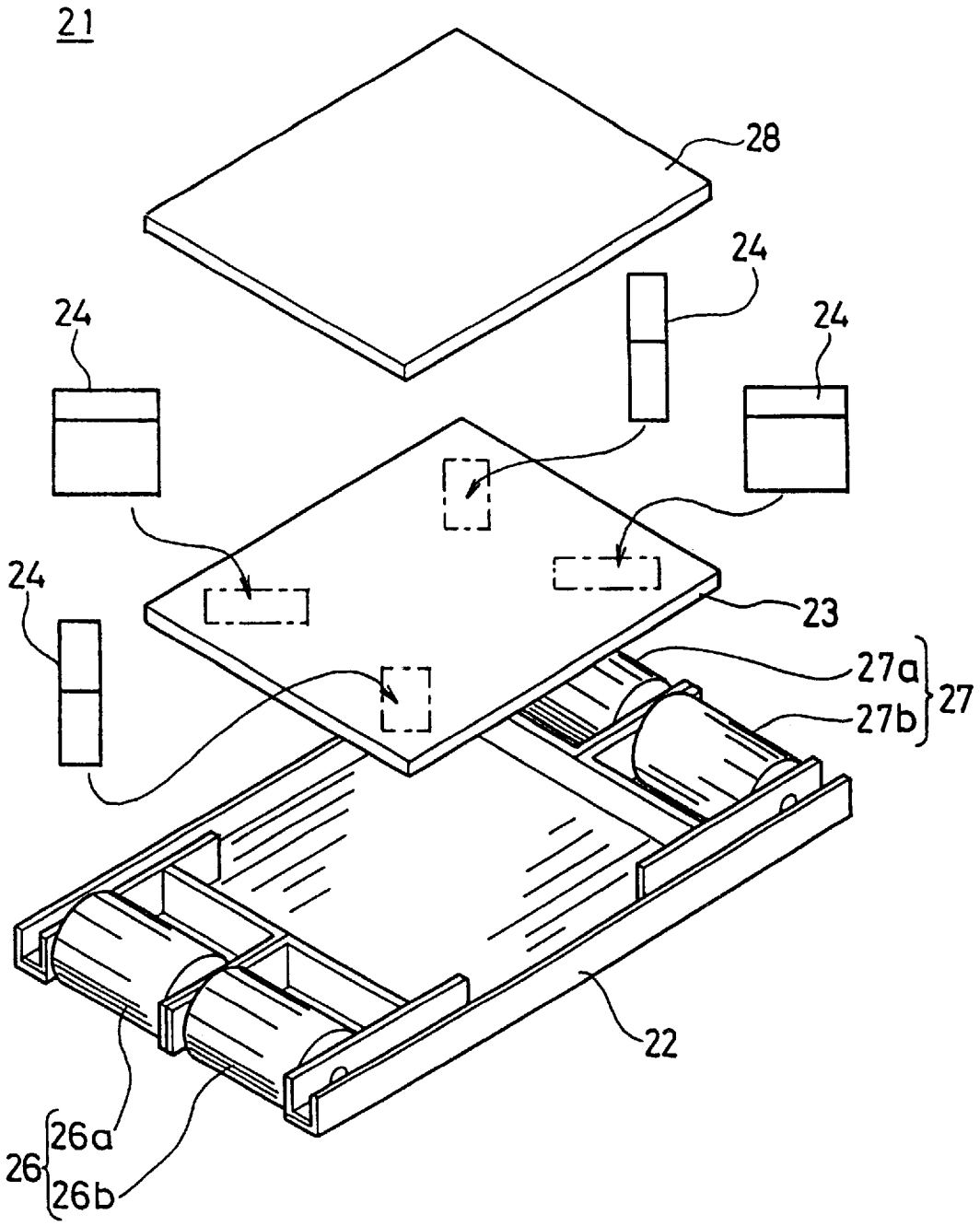
FIG. 3 is an exploded perspective view of a carriage in the apparatus.

As shown in FIGS. 1 and 3, the carriage 21 movable along the rails 12 and 12 includes a carriage body 22, an auxiliary plate 23 of a rectangular shape, and shock absorbers 24. The carriage body 22 is provided at its front and rear ends with a front end roller 26 and a rear end roller 27 which rollingly move on the rails 12 respectively. The carriage body 22 is made by assembling and welding steel members into a desired shape. The front end roller 26 is made up of a pair of small rollers 26*a* and 26*b,* while the rear end roller 27 is made up of a pair of small rollers 27*a* and 27*b.* The small rollers 26*a,* 26*b,* 27*a* and 27*b* are independently rotatably mounted for rolling movement on the respective rails 12 and 12. With such an arrangement, in a case where the rails 12 and 12 are laid along a bent transportation path, a rotational difference between the small rollers 26*a,* 26*b,* 27*a* and 27*b* during running of the carriage 21 can be accommodated or absorbed.

The auxiliary plate 23 is mounted in an upper part of the carriage body 22, and four shock absorbers 24 are attached onto an upper surface of the auxiliary plate 23 at its four corners (shown by chain-dotted lines in FIG. 3). Mounted on upper faces of the shock absorbers 24 is a base plate 28 of a rectangular parallelopiped shape so that, as shown in FIG. 1, the monitor camera 11 is mounted on the base plate 28 through a vibration isolating device 29. In this way, since the shock absorbers 24 are disposed between the auxiliary plate 23 and base plate, vibration of the carriage 21 during its running can be prevented from being transmitted directly to the monitor camera 11. Such an accessory device (not shown) as a battery is accommodated in a space defined between the shock absorbers 24. Further, as shown in FIG. 1, a projection 33*a* of a connecting plate 33 as the transporting means 31 is mounted to a side face of the carriage body 22.

As shown in FIG. 1 and FIGS. 4 to 7, the pipe 32 as the transporting means 31 fixed to the upper part of the upright part 16*a* is formed in its lower part with a slit 32*a* which is extended along the full length of the pipe 32. Inserted in the interior of the pipe 32 is an internal moving body 34 which can be moved by means of compressed air supplied into the pipe 32 is connected at its lower side with an upper end of the connecting plate 33 mounted to the side face of the carriage body 22. The connecting plate 33 is extruded downwardly of the pipe 32 as passed through the slit 32*a.* Disposed within the pipe 32 along the full length of the pipe 32 is a sealing wire 36 of a rubber wire of a circular section which can block the slit 32*a.* The slit 32*a* has a first slit part 32*b* facing an outer bottom face of the pipe 32 and a second slit part 32*c* facing an inner bottom face of the pipe 32 (refer to FIGS. 6 and 7).

Figure 6:
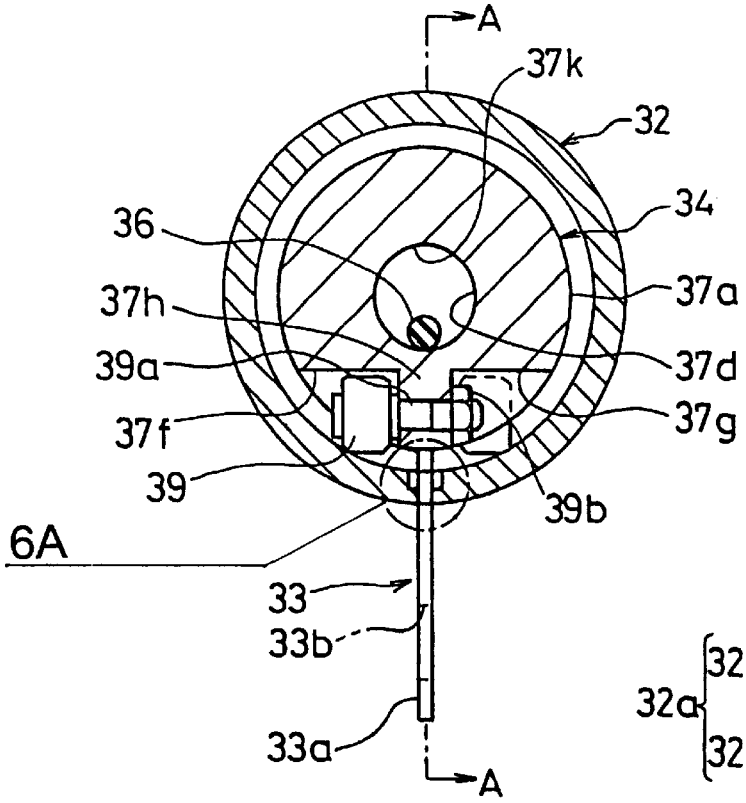
FIG. 6 is a cross-sectional view taken along line B—B in FIG. 4.
Figure 6A:
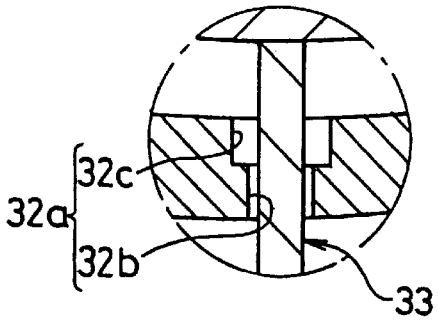
Figure 7:
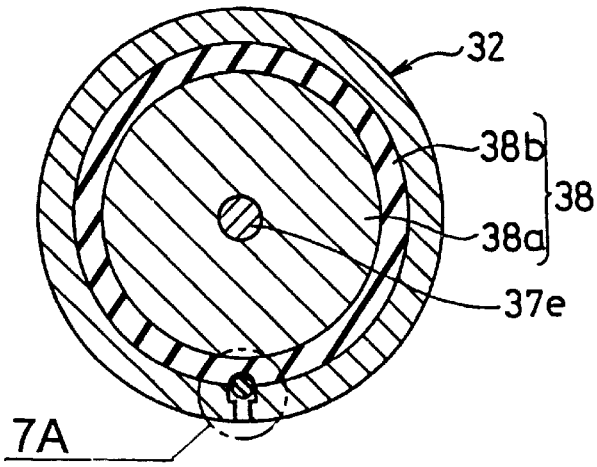
FIG. 7 is a cross-sectional view taken along line C—C in FIG. 4.
Figure 7A:
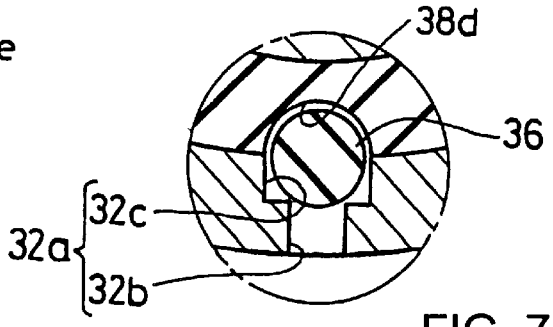

As shown in FIGS. 6 and 7, the first slit part 32*b* is made smaller than an outer diameter of the sealing wire 36 and is slightly larger in width than the thickness of the connecting plate 33; whereas, the second slit part 32*c* is made to have a width that is substantially the same as the outer diameter of the sealing wire 36 and that is slightly larger than the outer diameter of the sealing wire 36, so that a lower part of the sealing wire 36 can be accommodated into the second slit part 32*c.* In this connection, the sectional shape of the sealing wire is not limited to the circle but may be an ellipse, rectangle or other polygon; while the section of the second slit part may have a shape corresponding to the sectional shape of the lower part of the sealing wire. Alternatively, the slit may have no second slit part and have the first slit part which is smaller in width than the outer diameter of the sealing wire. Further, the depth of the second slit part may be made substantially equal to the outer diameter of the sealing wire so that the entire sealing wire can be accommodated in the second slit part. Furthermore, the slit may be made by machining simultaneously with molding of the pipe or after the pipe molding. Or the pipe may formed therein with a second slit part, and a plate having a first slit part may be fusedly bonded to the outer bottom face of the pipe.

Figure 4:
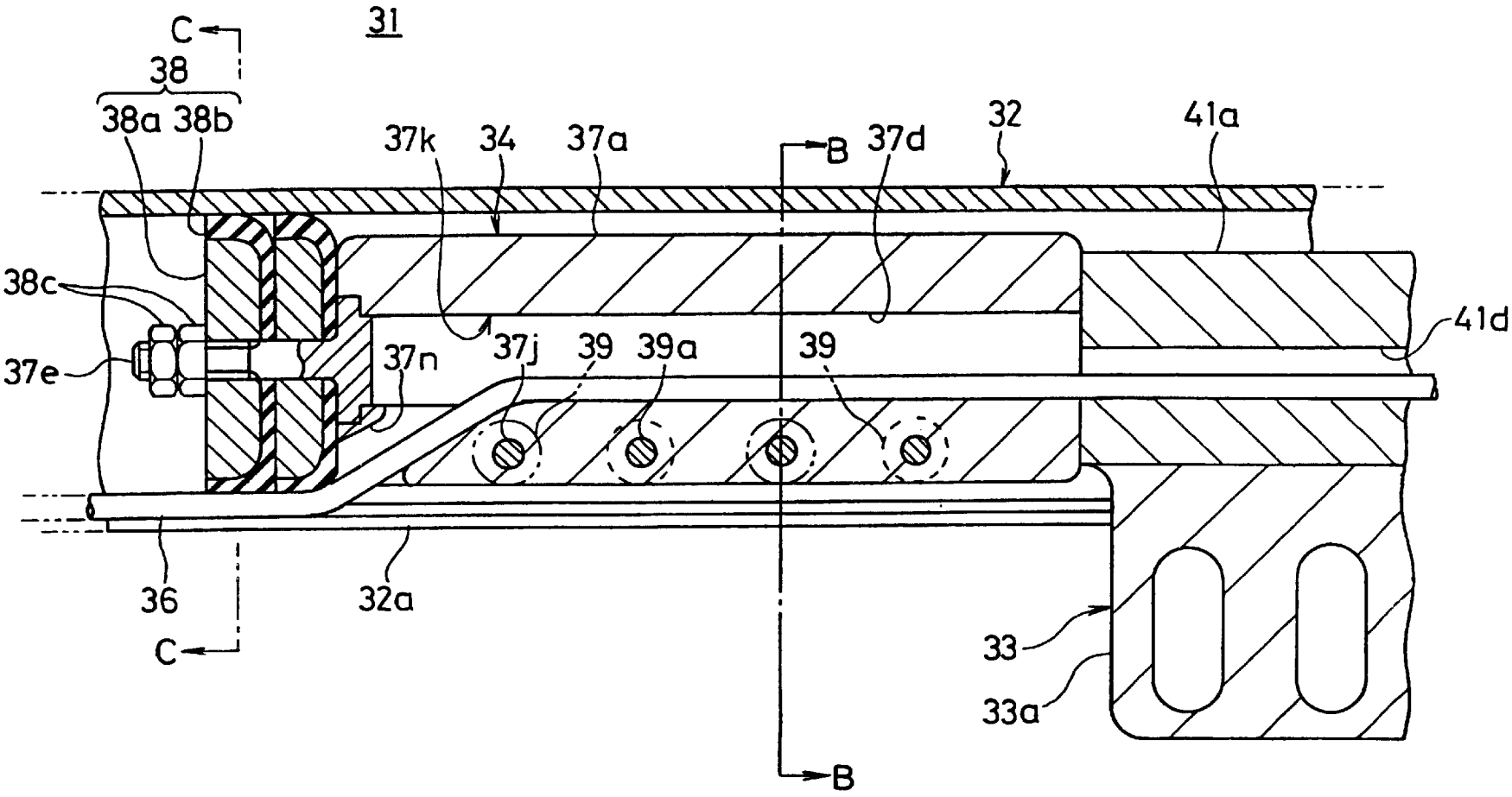
FIG. 4 is a cross-sectional view taken along line A—A in FIG. 6, showing a first driving shaft in an internal moving body.
Figure 5:
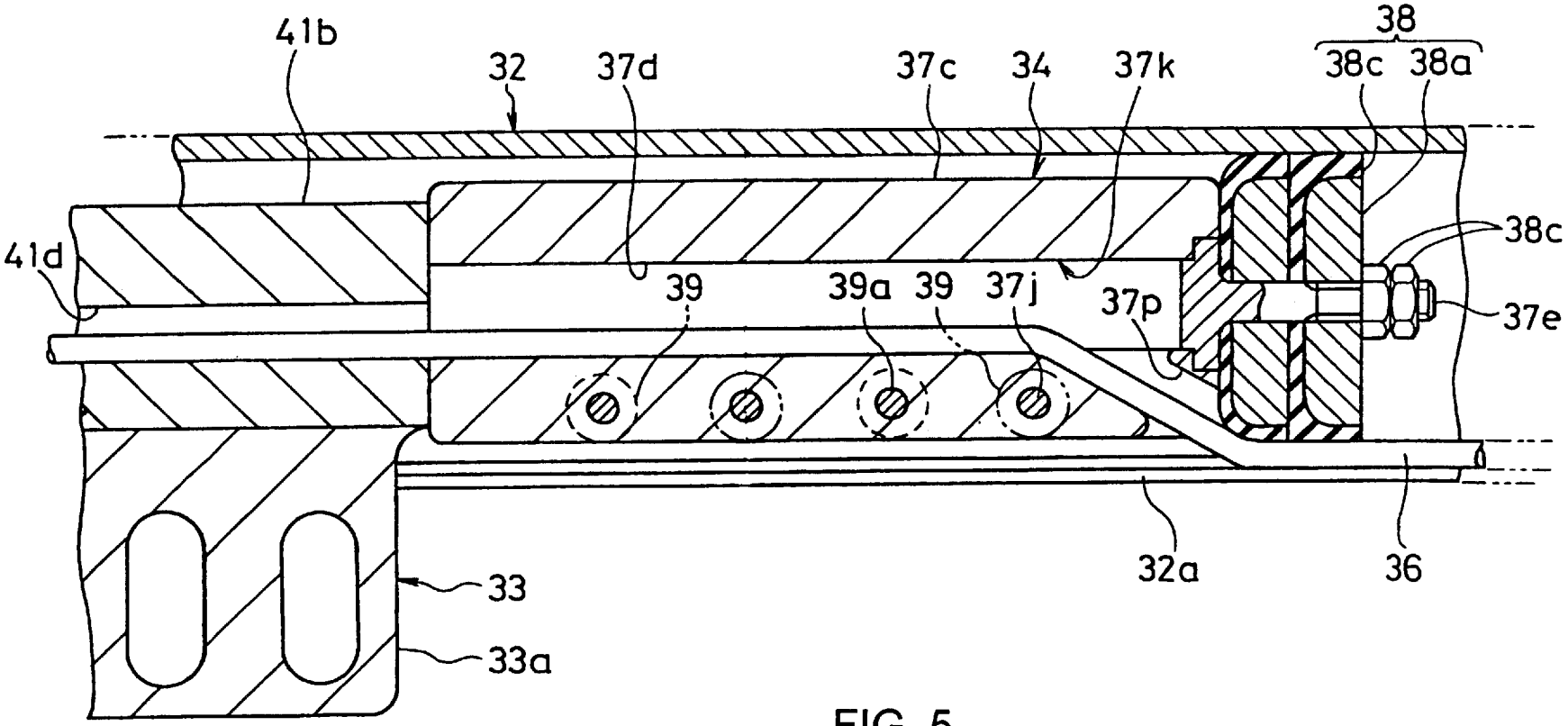
FIG. 5 is a cross-sectional view taken along line A—A in FIG. 6, showing a third driving shaft in the internal moving body.
Figure 8:
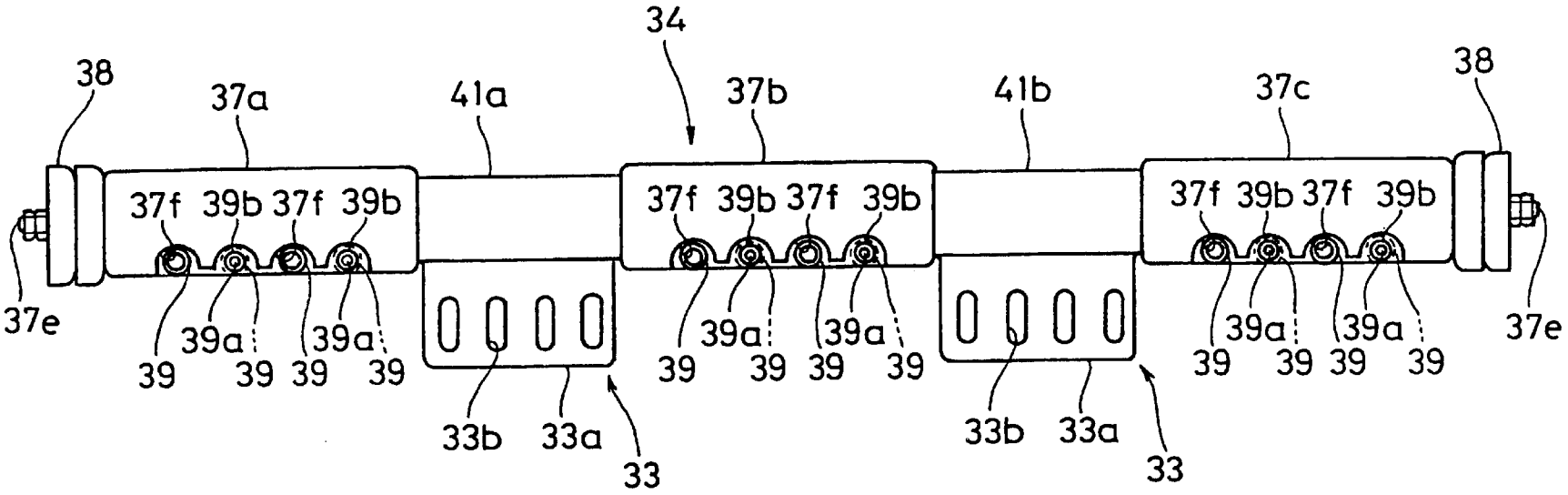
FIG. 8 is a side view of the internal moving body and a connecting plate in the apparatus.

As shown in FIG. 8, the internal moving body 34 in the present embodiment includes three first, second and third moving shafts 37*a,* 37*b* and 37*c* formed as extended parallel to an axial center of the pipe 32; two first and second connecting shafts 41*a* and 41*b* linearly connecting the moving shafts 37*a,* 37*b* and 37*c;* seals 38 and 38 fixedly mounted to as contacted with front and rear ends of the first and third moving shafts 37*a* and 37*c* located at front and rear ends of the internal moving body 34 so as to keep the inside of the pipe 32 air tight; and rotors 39 rotatably mounted to the respective moving shafts 37*a,* 37*b* and 37*c* and rollingly movable along the inner bottom face of the pipe 32 Since the three first, second and third moving shafts 37*a,* 37*b* and 37*c* as well as the two first and second connecting shafts 41*a* and 41*b* have respectively the same structures, explanation will be made, as representative examples by referring to FIG. 4 showing the first moving shaft 37*a* and a part of the first connecting shaft located at the front end, and by referring to FIG. 5 showing the third moving shaft 37*c* and a part of the second connecting shaft, and explanation of the second moving shaft 37*b* located in the middle thereof will be omitted.

As shown in FIGS. 4 and 5, the moving shafts 37*a* and 37*c* are formed therein with an insertion bore 37*d* passed therethrough along their axial center Fixedly mounted to the front and rear ends of the moving shafts 37*a* and 37*c* located at the front and rear ends of the transporting means 31 are a pair of seal holding shafts 37*e* and 37*e* which close the front and rear ends of the insertion bore 37*d* and which are aligned with the axial center of the moving shafts 37*a* and 37*c* respectively. The seal 38 has a disk-shaped core 38*a* and a resident member 38*b* bonded to an outer peripheral face and one side of the core 38*a*. The resident member 38*b* is contacted at its outer peripheral face with the inner face of the pipe 32 to be slidably moved air-tightly along the inner face of the pipe 32. The two seals 38 are fitted to the seal holding shaft 37*e* and then two nuts 38*c* are screwed to the seal holding shaft 37*e* to thereby be fixed. Usable as the resident member 38*b* is a soft or hard synthetic rubber, soft plastic, sponge or the like so long as it can keep the interior of the pipe air-tight.

As shown in FIG. 7, the seals 38 and 38 is formed with a guide groove 38*d* which has a shape corresponding to an upper part of the sealing wire 36 extruded into the pipe 32 in a lower end of the seal 38, that is, at a position facing the sealing wire 36 accommodated in its lower part in the second slit part 32*c*. The upper part of the sealing wire 36 is accommodated in the guide groove 38*d*. In this conjunction, the number of the seals 38 and 38 to be fitted to the seal holding shaft 37*e* is not limited to two but may be one or three or more. Further, with respect to the seal 38, a composite plate may be obtained by alternately positioning a synthetic rubber and a sponge, the composite plate may be provided at its both sides with iron plates and be fitted to the seal holding shaft 37*e*, and the nut 38*c* may be screwed and fastened to the seal holding shaft 37*e*.

As shown in FIGS. 6 and 8, the moving shafts 37*a*, 37*b* and 37*c* are formed in their one lower side faces with four first counter bore 37*f* as spaced by a predetermined interval in the longitudinal direction of the moving shafts; whereas, the moving shafts 37*a*, 37*b* and 37*c* are formed in the other lower side faces with four second counter bores 37*g* opposed to the first counter bores 37*f*. The opposing first and second counter bores 37*f* and 37*g* form four rotor holders 37*h* at the lower tion opartf the moving shaft (refer to FIG. 6). Formed in the center of each of the rotor holders 37*h* is a through hole 37*j* (refer to FIGS. 4 and 5) passed therethrough from the first counter bore 37*f* to the second counter bore 37*g*.

As shown in FIGS. 4 to 6 and FIG. 8, the rotors 39 are four needle bearings rotably fitted into four shafts 39*a*. The four rotors 39 are mounted in the lower part of each of the moving shafts 37*a*, 37*b* and 37*c*, by inserting the four shafts 39*a* into the four through holes 37*j* so that the rotor 39 are alternately accommodated in the first and second counter bores 37*f* and 37*g* and then by screwedly tightening the nuts 39*b* thereto. The rotors 39 are arranged so that one outer peripheral edges of the rotors are rollingly contacted with the inner bottom face of the pipe 32 (refer to FIG. 6). In this connection, the number of such rotors may be two, three, five or more, and the rotor may be fitted to both ends of the shaft passed through the through-hole. In order to increase a contact area between the rotor and the inner bottom face of the pipe, the inner bottom face of the pipe may be made flat. In this case, it becomes necessary to form the bottom part of the resilient member of the seal to be flat corresponding to the inner bottom face of the pipe.

The connecting plates 33 connected to the connecting shafts 41*a* and 41*b* in pair by welding upper ends of the connecting plates 33 to lower faces of the associated connecting shafts 41*a* and 41*b*. The projections 33*a* and 33*a* of the pair of plates 33 and 33 projected downwardly of the pipe 32 are each formed therein with 4 engagement holes 33*b* (refer to FIG. 8). The internal moving body 34 is formed therein with wire a retracting part 37*k* (refer to FIGS. 4 to 6). The wire retracting part 37*k* has the insertion bores 37*d* formed in the respective moving shafts 37*a*, 37*b* and 37*c*; through bores 41*d* formed in the respective connecting shafts 41*a* and 41*b*; and a pair of communication holes 37*n* and 37*p* which are extended obliquely upwardly from lower parts of the front and rear ends of the moving shafts 37*a* and 37*c* located at the front and rear ends of the transporting means in mutually approaching directions and which communicate with the insertion bore 37*d*. When the sealing wire 36 is inserted into the wire retracting part 37*k*, the sealing wire 36 opposed to the connecting plate 33 is retraced inwardly of the pipe 32. In this connection, for the purpose of reducing the frictional resistance between the sealing wire and the internal faces of the insertion bore and communication hole, the insertion bore and communication hole may be coated on their inside faces with such friction reducing material as fluorine resin, or balls or rollers may be rotably embedded as spaced by predetermined intervals in inside bottom faces of the insertion bore and communication hole to be contacted with the sealing wire.

Figure 9:
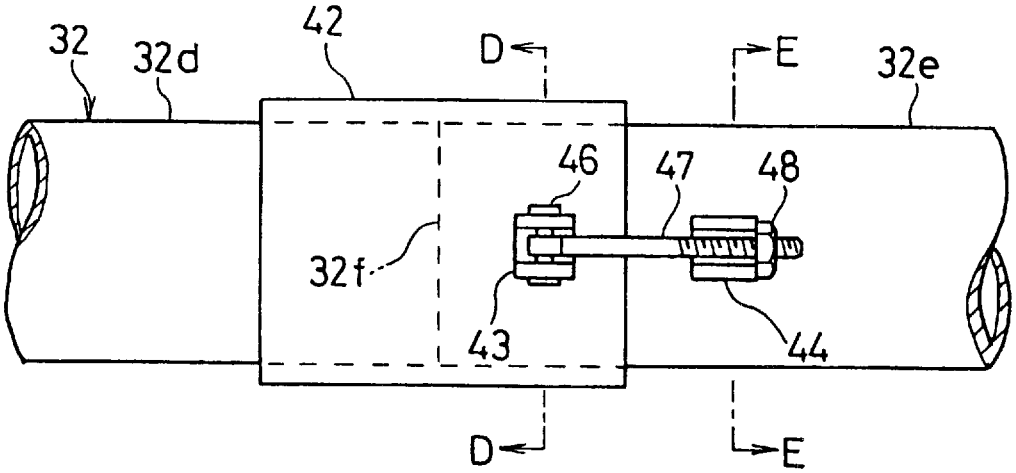
FIG. 9 is a side view of pipes in the apparatus showing how to interconnect the pipes together.
Figure 10:
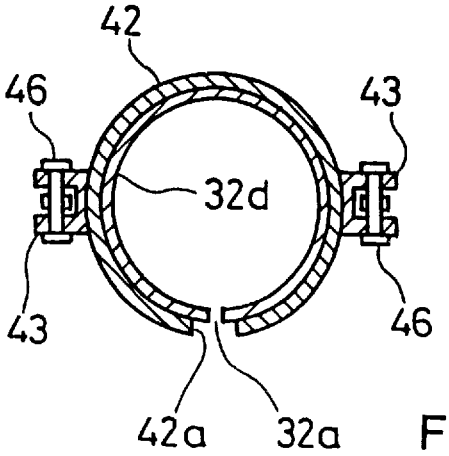
FIG. 10 is a cross-sectional view taken along line D—D in FIG. 9.
Figure 11:
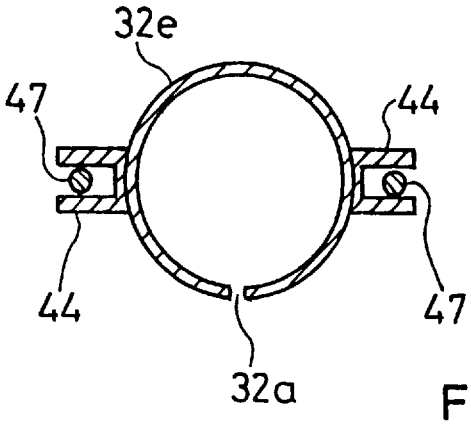
FIG. 11 is a cross-sectional view taken along line E—E in FIG. 9

The pipe 32 can comprise a plurality of pipes connected to each other according to the transportation distance of the monitor camera 11. In this case, as shown in FIGS. 9 and 11, a pipe 32*e* is coupled at its tip end with a base end of a pipe 32*d* by means of a connecting pipe 42. The connecting pipe 42 is coupled with the pipes 32*d* and 32*e* so as to leave the slit 32*a* of the pipes 32*d* and 32*e* and to cover a seam 32*f* between the both pipes 32*d* and 32*e* (refer to FIG. 9). More specifically, the connecting pipe 42 has an open slit 42*a* that is formed therein along the full length of the connecting pipe 42 and that is larger in width than the slit 32*a* (refer to FIG. 10). The slit 32*a* is positioned in the center of the open slit 42*a*, and then one end of the connecting pipe 42 is welded and connected to the base end of the pipe 32*d*. The connecting pipe 42 is provided on its other outer face with first pedestals 43, whereas, the pipe 32*e* is provided on its tip end outer face with second pedestals 44.

The first and second pedestals 43 and 44, which are each formed into a letter-U shape, are welded to the outer face of the connecting pipe 42 and to the outer face of the pipe 32*e* respectively The first pedestal 43 has a pin 46 and a screw 47 which is pivotably connected at its base end thereto through the pin 46. The screw 47 has such a length that its tip end reaches the second pedestals 44 when the base end of the pipe 32*d* is connected to the tip end of the pipe 32*e*. In order to couple the both pipes 32*d* and 32*e* with use of the connecting pipe 42, the pipe 32*e* is inserted into an open end of the connecting pipe 42 welded to the pipe 32*d*. Under such a condition that both pipes 32*d* and 32*e* are coupled to each other, the screws 47 are inserted from their tip ends into the second pedestals 44 to be bridged between the first and second pedestals 43 and 44, and then nuts 48 are screwed to the tip ends of the screws 47. When the nuts 48 are tightened, the pipes 32*d* and 32*e* are tightly coupled to each other so that there is no gap in the seam 32*f*. In this connection, the pipe to be joined may be provided on its other end outer face with a second pedestal, and the connecting pipe may be provided on its tip end outer face with a first pedestal having a screw whose base end is pivotably connected thereto.

Explanation will next be made as to how to use the monitor camera transporting apparatus having such an arrangement as mentioned above and using compressed air.

First, such a compressed air generating device as a compressor (not shown) is disposed in the vicinity of a base end of the pipe 32, and air hoses (not shown) extended from the compressor are connected to both ends of the pipe 32 through an air adjustment valve (not shown). For transporting such a monitor camera 11 as shown in FIG. 1, the air adjustment valve provided in the air hose connected to the base end of the pipe 32 is opened to introduce compressed air from the base end side into the pipe 32 The introduction of the compressed air causes the internal moving body 34 to be propelled toward the tip end of the pipe under the pressure of the compressed air. As the internal moving body 34 is propelled, the carriage 21 is moved along the rails 12 and 12 through the connecting plate 33, so that the monitor camera 11 mounted on the carriage 21 is transported along the rails 12 and 12.

When the connecting plate 33 passes along the slit 32*a*, the sealing wire 36 passes through the wire retracting part 37*k*, so that the sealing wire 36 is retracted inwardly of the pipe 32 For this reason, the connecting plate 33 can smoothly move along slit 32*a* without being hindered by the sealing wire 36. It is only when the sealing wire 36 is positioned between the seals 38 and 38 of the internal moving body 34 that the sealing wire 36 is retracted inwardly of the pipe 32 to open the slit 32*a*. The sealing wire 36 retracted inwardly of the pipe is guided into the second slit part 32*c* by means of the guide groove 38*d* of the seals 38 and 38 so that the sealing wire 36 located at a position other than a position between the seals 38 and 38 is brought into close contact with the slit 32*a*. Further, since the seam 32*f* between the pipes 32*d* and 32*e* is sealed by the connecting pipe 42 (refer to FIG. 9), the compressed air will not leak into outside the pipe 32. For this reason, during movement of the internal moving body 34, the pressure of the compressed air is kept at a constant level, so that the internal moving body 34 can smoothly moved forwards and the monitor camera 11 can be transported efficiently and safely.

Further, by changing the opening of the air adjustment valve and/or the pressure of the compressed air, the internal moving body 34 can be accelerated or decelerated to run the carriage 21 acceleratingly or deceleratingly, thereby the monitor camera 11 can be transported at a desired speed.

When it is desired to return the internal moving body 34 to the base end of the pipe 32, the air adjustment valve provided in the air hose connected to the base end of the pipe 32 is opened to introduce the compressed air from the tip end side of the pipe 32 thereinto. In this way, by controlling the amount and pressure of compressed air to be introduced into the pipe 32, the monitor camera 11 can be transported at a desired speed or up to a desired position.

As has been explained in the foregoing, in accordance with the present invention, there is provided a monitor camera transporting apparatus which comprises rails laid along a transportation path of a monitor camera, a carriage having the monitor camera mounted thereon and movable along the rails, and transporting means for moving the carriage by means of compressed air, and wherein the transporting means moves the carriage along the rails by means of the compressed air to thereby transport the monitor camera mounted on the carriage along the rails As a result, even at such dangerous place where no persons are allowed to enter and no electric motors can be used, the monitor camera can be transported efficiently and safely even to such an object to be photographed as moving at a high speed, while it can be avoided that the sealing wire blocks the movement of the internal moving body under the influence of the compressed air, thus enabling reliable and strong appealing photographing.

Further, since the slit is made in the lower face of the pipe along the longitudinal direction thereof, the internal moving body movable within the pipe by means of the compressed air is inserted into the pipe, the carriage is mounted to the connecting plate connected to the internal moving body, the sealing wire capable of closing the slit is disposed inside the pipe, and the internal moving body or connecting plate is formed with the wire retracting part for retracting the sealing wire inwardly of the pipe; so that, at a connecting-plate passage position, the sealing wire can be retracted inwardly of the pipe by the wire retracting part. As a result, the monitor camera can be transported efficiently and safely even to such an object to be photographed as moving at a high speed, while it can be avoided that the sealing wire blocks the movement of the internal moving body under the influence of the compressed air, thus enabling reliable and strong appealing photographing.

Furthermore, the carriage includes a carriage body having rollers which are provided at its front and rear ends to be rollingly moved on the rails, an auxiliary plate mounted in an upper part of the carriage body, a base plate on which the monitor camera is mounted, and shock absorbers disposed between the auxiliary plate and base plate. Therefore, when the projection of the connecting plate is mounted onto the side face of the carriage body, the rollers and thus the carriage can be smoothly moved on the rails. Since the shock absorbers are disposed between the auxiliary plate and base plate, it can be avoided that the vibration of the carriage body is transmitted directly to the monitor camera. As a result, it can be prevented that an image photographed by the monitor camera is blurred due to the camera shake.

In addition, since the resilient member is fixedly mounted along the full length of the rails onto the upper faces of the rails on which the rollers are rolling, noise generated by the running of the carriage can be suppressed.

While the present invention has been described in connection with a certain preferred embodiment, it is to be understood that the subject matter encompassed by the present invention is not limited to the specific embodiment. On the contrary, it is intended to include all alternatives, modifications, and equivalents as can be included within the spirit and scope of the following claims.

What is claimed is:

1. A monitor camera transporting apparatus (10) based on compressed air, comprising rails (12, 12) laid along a transportation path of a monitor camera (11);

a carriage (21) having the monitor camera (11) mounted thereon and movable along the rails (12, 12); and transporting means (31) for moving the carriage (21) by means of compressed air, Wherein the transporting means (31) includes:

a pipe (32) provided parallel to the rails (12, 12) and having a slit (32*a*) formed in its lower part along a full length of the pipe;

an internal moving body (34) inserted into said pipe (32) and movable within the pipe (32) by means of compressed air introduced into the pipe (32);

a connecting plate (33) connected at its one end to the internal moving body (34) within the pipe (32) and projected at the other end externally of the pipe (32) through the slit (32*a*), said carriage (21) being connected to the projection (33*a*);

a sealing wire (36) disposed within the pipe (32) along the full length of the pipe (32) to close the slit (32*a*); and a wire retracting part (37*k*) formed in the internal moving body (34) or connecting plate (33) for retracting inwardly of the pipe (32) the sealing wire (36) located at the connecting plate (33).

2. A monitor camera transporting apparatus based on compressed air as set forth in claim 1, wherein said carriage (21) includes a carriage body (22) having rollers (26, 27) which are provided at its front and rear ends to be rollingly moved on the rails, an auxiliary plate (23) mounted in an upper part of said carriage body (22), a base plate (28) on which the monitor camera (11) is mounted, and shock absorbers (24) disposed between the auxiliary plate (23) and base plate (28), and wherein the projection (33*a*) of the connecting plate (33) is mounted onto the side face of the carriage body (22).

3. A monitor camera transporting apparatus based on compressed air as set forth in claim 2, wherein a resilient member (12*a*) is fixedly mounted on upper faces of the rails (12, 12) on which the rollers (26, 27) are roll along the full length of the rails (12, 12).

* * * * *